US011255229B2

(12) United States Patent
VanWingerden

(10) Patent No.: US 11,255,229 B2
(45) Date of Patent: Feb. 22, 2022

(54) INTEGRATED ENGINE BRAKE CONFIGURATION

(71) Applicant: Eaton Intelligent Power Limited, Dublin (IE)

(72) Inventor: Mark VanWingerden, Battle Creek, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/789,852

(22) Filed: Feb. 13, 2020

(65) Prior Publication Data

US 2020/0182108 A1 Jun. 11, 2020

Related U.S. Application Data

(63) Continuation of application No. PCT/US2018/045956, filed on Aug. 9, 2018.

(60) Provisional application No. 62/545,184, filed on Aug. 14, 2017, provisional application No. 62/550,950, filed on Aug. 28, 2017, provisional application No. 62/575,598, filed on Oct. 23, 2017.

(51) Int. Cl.

| | |
|---|---|
| ***F01L 13/06*** | (2006.01) |
| ***F01L 1/047*** | (2006.01) |
| ***F01L 1/18*** | (2006.01) |
| *F01L 1/46* | (2006.01) |

(52) U.S. Cl.

CPC ..... *F01L 13/06* (2013.01); *F01L 1/047* (2013.01); *F01L 1/18* (2013.01); *F01L 1/462* (2013.01); *F01L 2001/467* (2013.01)

(58) Field of Classification Search

CPC ... F01L 13/06; F01L 1/047; F01L 1/18; F01L 1/181; F01L 2001/467

USPC ..... 123/90.39, 90.44

See application file for complete search history.

(56) References Cited

U.S. PATENT DOCUMENTS

2012/0186546 A1* 7/2012 Cecur ..... F01L 13/0031 123/90.15
2015/0144096 A1* 5/2015 Meneely ..... F01L 13/06 123/321
2015/0159520 A1* 6/2015 Cecur ..... F01L 1/2411 123/90.12

FOREIGN PATENT DOCUMENTS

EP 2867482 B1 12/2016
GB 2540736 A * 2/2017 ..... F01L 1/26

(Continued)

OTHER PUBLICATIONS

International Search Report and Written Opinion for International Application No. PCT/US2018/045956 dated Nov. 30, 2018.

(Continued)

*Primary Examiner* — Devon C Kramer
*Assistant Examiner* — Kelsey L Stanek
(74) *Attorney, Agent, or Firm* — RMCK Law Group PLC

(57) ABSTRACT

An exhaust valve rocker arm for an exhaust valve rocker arm assembly operable in a combustion engine drive mode and an engine braking mode, and configured to selectively open first and second exhaust valves, includes a body defining an aperture to receive a rocker shaft such that the body is rotatable about the rocker shaft, a bore defined in the body, and a rotating stepped engine brake capsule disposed in the bore and having a castellation mechanism. The rotating stepped engine brake capsule is movable between a locked, engine brake active position and an unlocked, engine brake inactive position.

11 Claims, 14 Drawing Sheets

(56) References Cited

FOREIGN PATENT DOCUMENTS

| | | | |
|---|---|---|---|
| WO | 2011015603 | A2 | 2/2011 |
| WO | 2014001560 | A1 | 1/2014 |
| WO | 2015177127 | A1 | 11/2015 |
| WO | 2016155978 | A1 | 10/2016 |
| WO | 2016207348 | A1 | 12/2016 |
| WO | 2017053867 | A1 | 3/2017 |

OTHER PUBLICATIONS

European Search Report for EP Application No. 18845817.8 dated Apr. 21, 2021.

* cited by examiner

INTEGRATED ENGINE BRAKE CONFIGURATION

CROSS REFERENCE TO RELATED APPLICATIONS

This application is a continuation of International Application No. PCT/US2018/045956 filed Aug. 9, 2018, which claims the benefit of U.S. Provisional App. No. 62/545,184, filed Aug. 14, 2017, U.S. Provisional App. No. 62/550,950, filed Aug. 28, 2017, and U.S. Provisional App. No. 62/575,598, filed Oct. 23, 2017, the contents of which are incorporated herein by reference thereto.

FIELD

The present disclosure relates generally to a rocker arm assembly for use in a valve train assembly and, more particularly, to a rocker arm assembly that incorporates an integrated engine brake to perform an engine brake function.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

According to various aspects of the present disclosure, an exhaust valve rocker arm for an exhaust valve rocker arm assembly operable in a combustion engine drive mode and an engine braking mode, and configured to selectively open first and second exhaust valves is provided. In one example, the exhaust valve rocker arm includes a body defining an aperture to receive a rocker shaft such that the body is rotatable about the rocker shaft, a bore defined in the body, and a rotating stepped engine brake capsule disposed in the bore and having a castellation mechanism. The rotating stepped engine brake capsule is movable between a locked, engine brake active position and an unlocked, engine brake inactive position.

In addition to the foregoing, the described rocker arm may include one or more of the following features: a rocker arm spigot assembly configured to engage a valve bridge to selectively actuate the first and second exhaust valves; wherein the rotating stepped engine brake capsule having the castellation mechanism includes a first castellation member configured to rotate relative to a second castellation rotatable; and wherein the rotating stepped engine brake capsule further includes a biasing mechanism disposed between the first and second castellation mechanisms and configured to bias the first and second castellation mechanisms apart.

In addition to the foregoing, the described rocker arm may include one or more of the following features: wherein the first castellation member includes a gap disposed between fingers, and the second castellation member includes a stepped projection, wherein the stepped projection is received within the gap when the rotating stepped engine brake capsule is in the unlocked position such that the second castellation member is operable to collapse toward the first castellation member, and wherein the stepped projection engages one of the fingers when the rotating stepped engine brake capsule is in the locked position such that the exhaust valve rocker arm is configured to open the first exhaust valve to perform an engine braking operation.

In addition to the foregoing, the described rocker arm may include one or more of the following features: wherein the stepped projection includes a first stepped surface, a second stepped surface, and a slot; a plunger assembly operatively associated with the rotating stepped engine brake capsule to move the rotating stepped engine brake capsule between the locked and unlocked positions; wherein the plunger assembly comprises a plunger defining a seat to at least partially receive a biasing mechanism; wherein the plunger assembly is disposed within a second bore formed in the body; and wherein the plunger includes an annular flange configured to be received within the rotating stepped engine brake capsule, wherein translating movement of the plunger is configured to move the rotating stepped engine brake capsule between the locked and unlocked positions.

According to other aspects of the present disclosure, a rocker arm assembly operable in a combustion engine drive mode and an engine braking mode, and configured to selectively open first and second exhaust valves, is provided. In one example, the assembly includes a rocker shaft, an exhaust valve rocker arm configured to receive and rotate about the rocker shaft, and a rotating stepped engine brake capsule coupled to the exhaust valve rocker arm and having a castellation mechanism. The rotating stepped engine brake capsule is movable between a locked, engine brake active position and an unlocked, engine brake inactive position.

In addition to the foregoing, the described rocker arm assembly may include one or more of the following features: wherein the rotating stepped brake capsule with castellation mechanism is actuated by an intermediate rod; wherein the intermediate rod is actuated by a cam lobe disposed on a cam shaft; wherein intermediate rod is actuated by a solenoid; wherein the rotating stepped brake capsule with castellation mechanism is actuated by a hydraulic actuator; and wherein the rotating stepped brake capsule with castellation mechanism is actuated by a rotating intermediate arm.

In addition to the foregoing, the described rocker arm assembly may include one or more of the following features: wherein the rotating intermediate arm is actuated by a camshaft; wherein the rotating intermediate arm is actuated by a solenoid; wherein the rotating stepped brake capsule with castellation mechanism is actuated by a solenoid acting on a plunger with a detent; and a plunger assembly operatively associated with the rotating stepped engine brake capsule to move the rotating stepped engine brake capsule between the locked and unlocked positions.

BRIEF DESCRIPTION OF THE DRAWINGS

The present disclosure will become more fully understood from the detailed description and the accompanying drawings, wherein.

DETAILED DESCRIPTION

Heavy duty (HD) diesel engines with single overhead cam (SOHC) valvetrains require high braking power, in particular at low engine speed. The present disclosure provides an added motion type decompression engine brake. To provide high braking power without applying high load on the rest of the valvetrain (particularly the camshaft), the present disclosure provides a rocker arm assembly having a rotating stepped brake capsule with castellation mechanism for engine braking that acts on one exhaust valve. In this regard, half of the input load is experienced compared to other configurations that have two exhaust valves opening.

Figure 1:
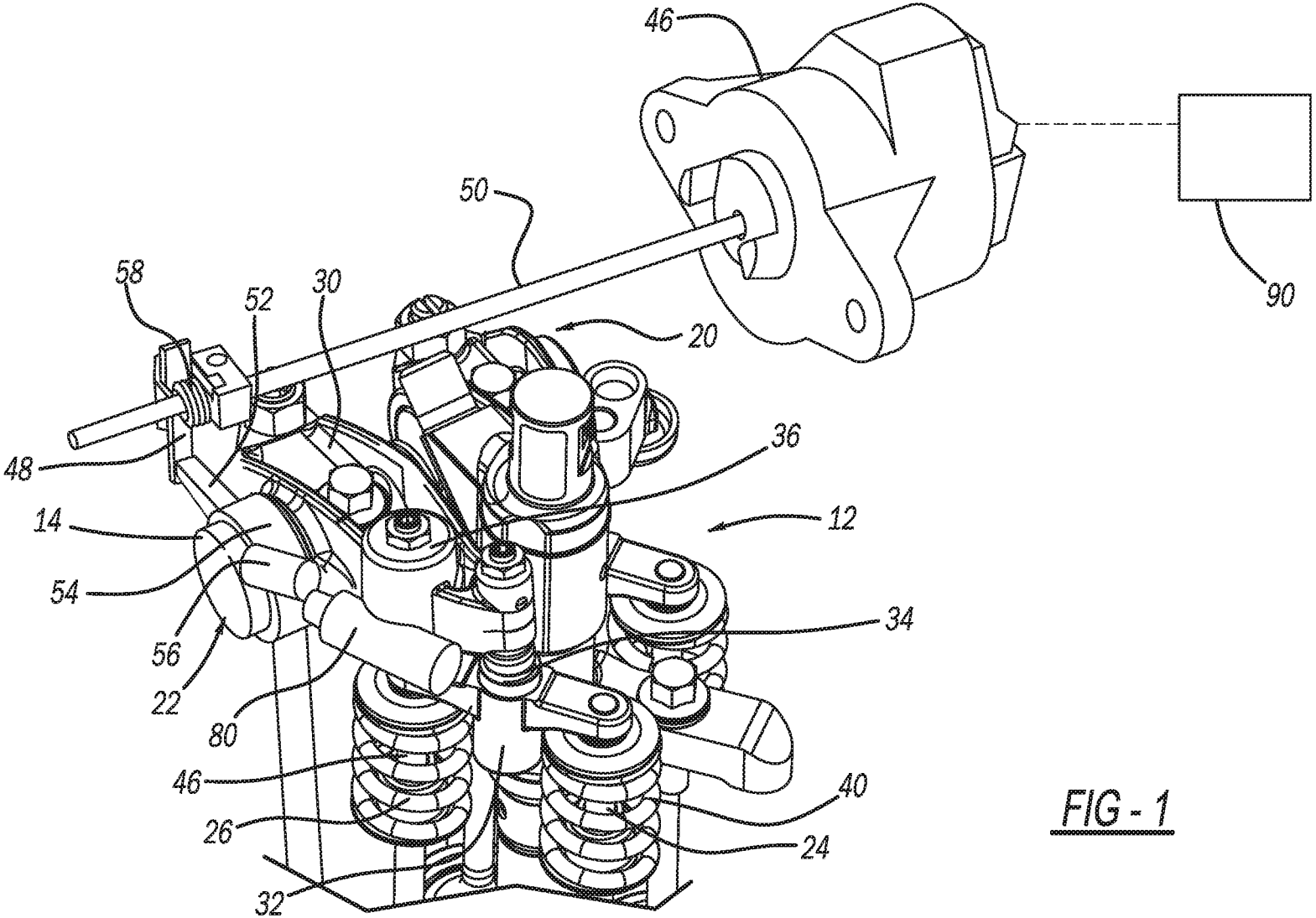
FIG. 1 is a top perspective view of a partial valve train assembly incorporating a rocker arm assembly having a lost motion spring configured for main lift and a rotating stepped brake capsule with castellation mechanism for engine braking constructed in accordance to one example of the present disclosure.

With reference to FIG. 1, a partial valve train assembly constructed in accordance to one example of the present disclosure is shown and generally identified at reference 10. The partial valve train assembly 10 utilizes engine braking and is shown configured for use in a six-cylinder engine. It will be appreciated however that the present teachings are not so limited. In this regard, the present disclosure may be used in any valve train assembly that utilizes engine braking. The partial valve train assembly 10 is supported in a valve train carrier 12 and can include two rocker arms per cylinder. A rocker shaft 14 is received by the valve train carrier 12 to support rotation of the rocker arms thereon.

In the example embodiment, each cylinder includes an intake valve rocker arm assembly 20 and an exhaust valve rocker arm assembly 22. The intake valve rocker arm assembly 20 is configured to control motion of intake valves of an associated engine (not shown).

In the example embodiment, the exhaust valve rocker arm assembly 22 incorporates integrated engine brake functionality and is configured to control opening of exhaust valves 24, 26 of the engine. In general, the exhaust valve rocker arm assembly 22 is configured to control exhaust valve motion in a combustion engine drive mode and an engine brake mode, as will be described herein in more detail. Moreover, the exhaust valve rocker arm assembly 22 is configured to act on one of the two exhaust valves 24, 26 during the brake mode.

Figure 2:
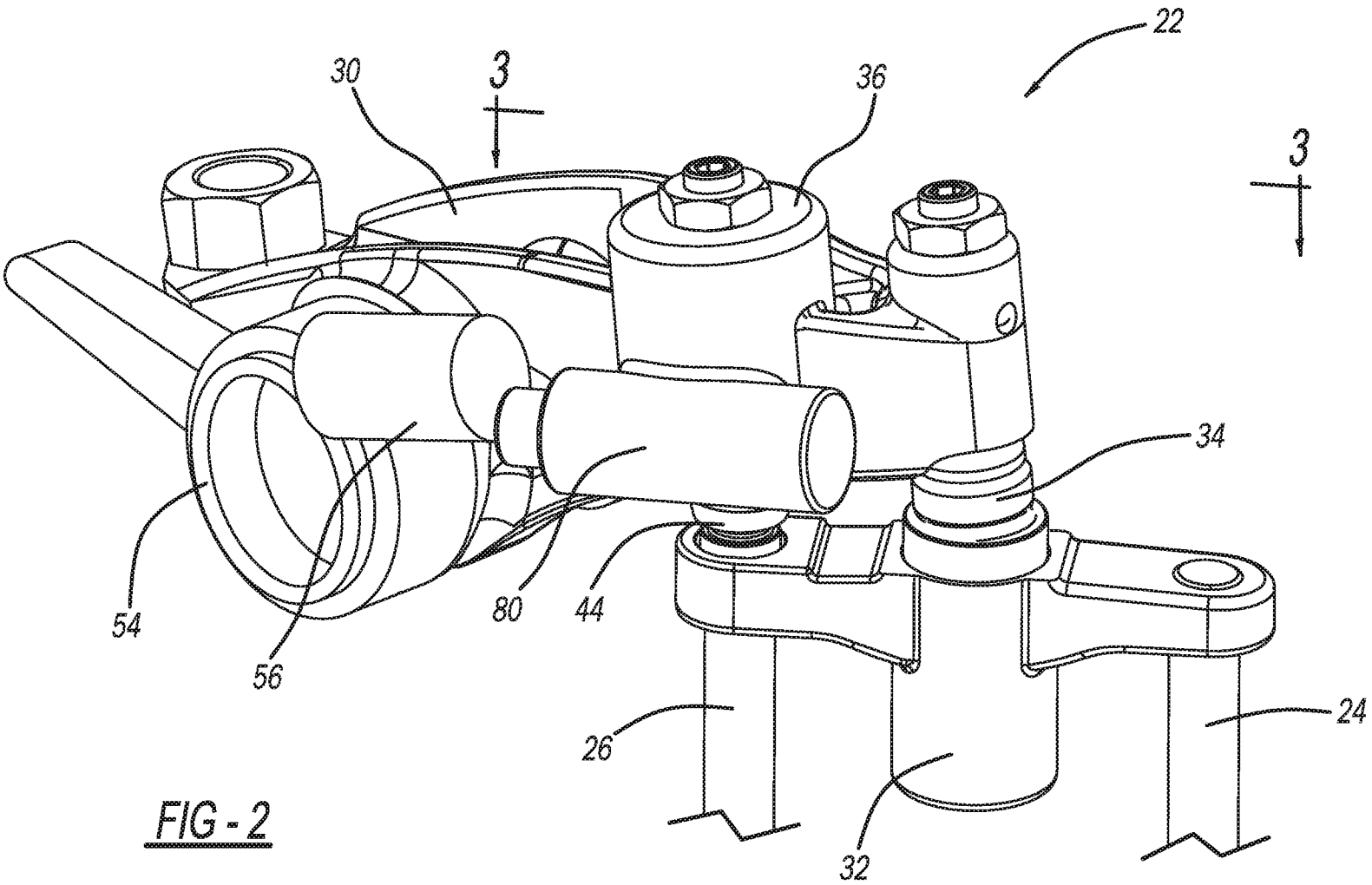
FIG. 2 is a front perspective view of an exhaust rocker arm and bridge of the assembly shown in FIG. 1.
Figure 3:
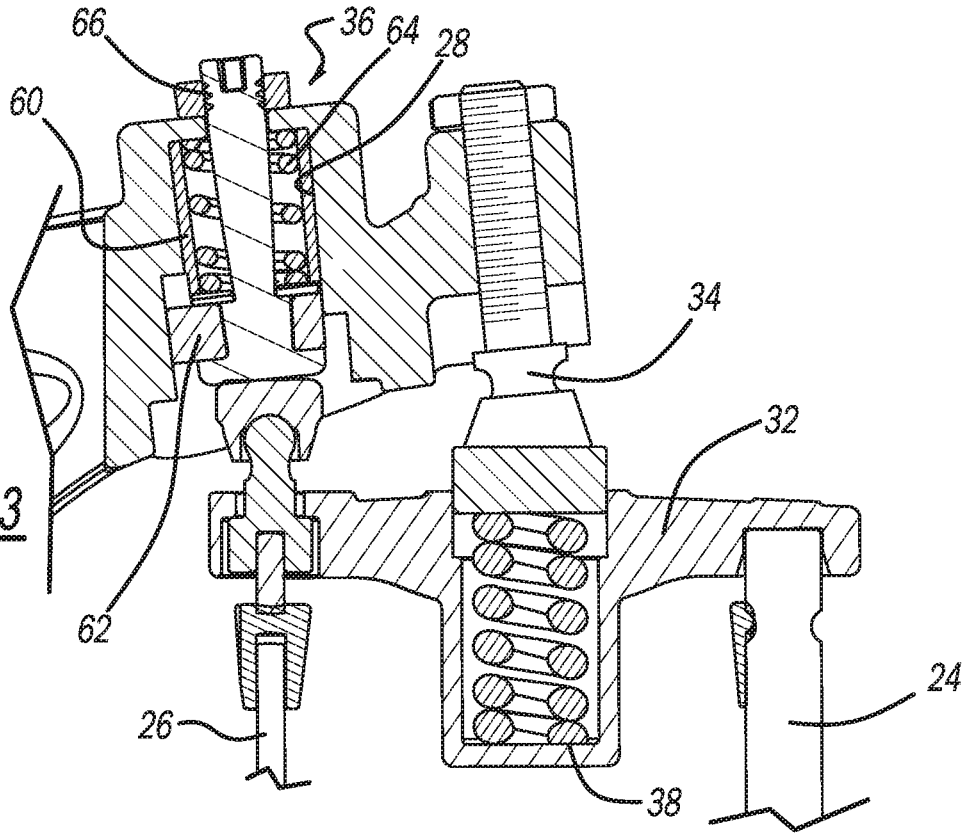
FIG. 3 is a sectional view of the exhaust rocker arm shown in FIG. 2 and taken along line 3-3.
Figure 4:
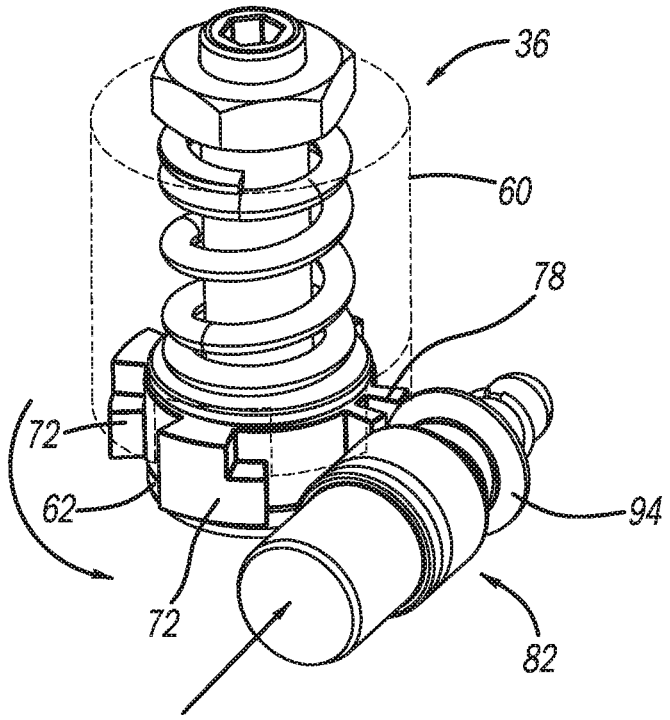
FIG. 4 is a front perspective view of the rotating stepped brake capsule with castellation mechanism of the exhaust rocker arm shown in FIG. 2.

With continued reference to FIGS. 2 and 3, exhaust valve rocker arm assembly 22 will be described in more detail. In one example, the exhaust valve rocker arm assembly 22 can generally include an exhaust rocker arm 30, a valve bridge 32, a spigot assembly 34, a rotating stepped engine brake capsule 36 with a castellation mechanism, and a lost motion spring assembly 38.

The valve bridge 32 is configured to engage the first and second exhaust valves 24, 26 associated with a cylinder of the engine. In the illustrated example, the first exhaust valve 24 is a non-braking exhaust valve that is biased by a valve spring 40, and the second exhaust valve 26 is a braking exhaust valve that is biased by a valve spring 42. The exhaust rocker arm 30 rotates around the rocker shaft 14 based on a lift profile of a cam shaft (not shown), as described herein in more detail, and a pass through pin 44 is positioned on the valve bridge 32 to enable actuation of exhaust valve 26 without actuation of valve bridge 32 or first exhaust valve 24.

In the example implementation, the exhaust rocker arm assembly 22 provides an integrated design with limited changes to a valvetrain, and the rotating stepped brake capsule 36 provides high durability and stiffness. Actuation of each brake capsule 36 is accomplished by an actuator 46 (FIG. 1), which is shown as a rotary actuator (e.g., electric or pneumatic) for all cylinders. Individual actuation arms 48 (FIG. 1) are provided for each exhaust rocker arm assembly 22, and the actuator 46 is configured to rotate a shaft 50 to actuate the arms 48.

Upon such rotation, actuation arms 48 are positioned to engage a projection 52 of an intermediate arm 54 to cause rotation thereof about rocker shaft 14. Rotation of the intermediate arm 54 about rocker shaft 14 causes an attached member or pin 56 to engage a plunger assembly 80 for actuation of the brake capsule 36, as described herein in more detail. Further, a biasing member 58 (FIG. 1) is provided on each individual actuation arm 48 to provide compliance such that the assembly can switch respective latch pins at available times rather than all at once.

With particular reference to FIGS. 3-6, the rotating stepped brake capsule 36 will be further described. In the example embodiment, brake capsule 36 is disposed within a bore 28 formed in rocker arm 30 and generally includes a first castellation member 60, a second castellation member 62, a castellation biasing mechanism 64, and a mechanical lash adjuster assembly 66.

In the example embodiment, the first castellation member 60 can be a cup-like castellated capsule body having a series of crenels or gaps 68 disposed between merlons or fingers 70, and the second castellation member 62 can be a ring-like member rotatably disposed within the first castellation member 60. In the illustrated example, second castellation member 62 includes a plurality of stepped projections 72 at least one of which defines a first stepped surface 74, a second stepped surface 76, and a slot 78. The castellation biasing member 64 (e.g., a spring) is configured to bias the first and second castellation members 60, 62 apart.

Figure 5:
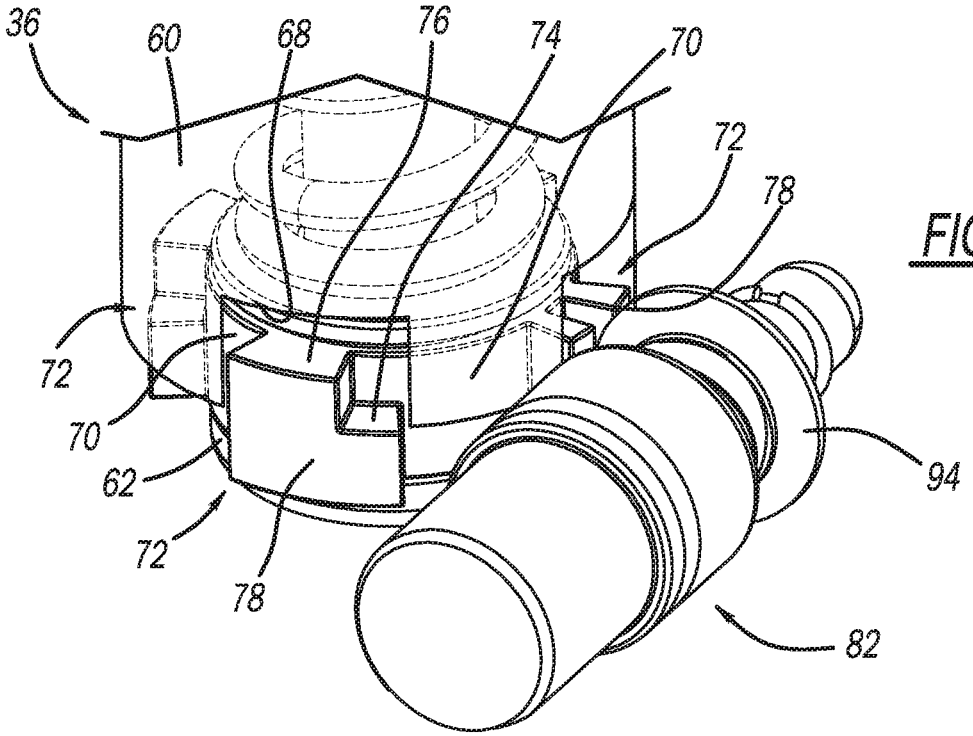
FIG. 5 is an enlarged view of the rotating stepped brake capsule with castellation mechanism of FIG. 4 and shown in an inactive engine brake position.
Figure 6:
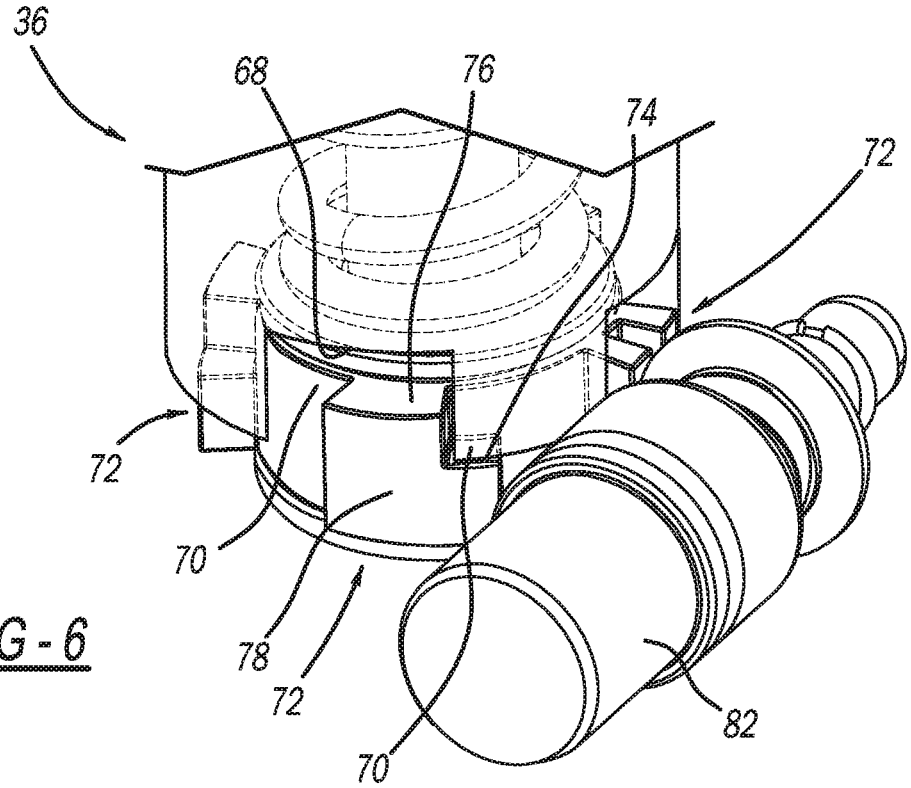
FIG. 6 is an enlarged view of the rotating stepped brake capsule with castellation mechanism of FIG. 5 and shown in an active engine brake position.

A plunger assembly 80 is configured to rotate the second castellation member 62 relative to the first castellation member 60 to switch the engine brake capsule 36 between a locked position (FIG. 6) and an unlocked position (FIG. 5).

In the example embodiment, the plunger assembly 80 generally includes a plunger 82 defining a seat 84, and a biasing mechanism 86 slidably disposed within a bore 88 formed in the rocker arm 30. The plunger 82 includes a first end 90, a second end 92, and an annular flange 94. The first end 90 is configured to be selectively engaged by intermediate arm pin 56, and the second end 92 defines seat 84. Biasing mechanism 86 (e.g., a spring) is disposed at least partially in seat 84 between plunger 82 and the end-wall forming bore 88. Moreover, in some embodiments, a second biasing mechanism 96 (e.g., a spring) can be disposed between the seat 84 and the plunger first end 90 (e.g., see FIG. 12) to provide optional compliance in the plunger assembly 80. The plunger annular flange 94 is disposed within slot 78 such that translation of the plunger 82 within bore 88 causes rotational movement of second castellation member 62, as described herein in more detail.

As discussed, the engine brake capsule 36 is movable between the brake inactive position and the brake active position via actuation of actuator 46. In the brake unlocked, inactive position (FIG. 5), the stepped projections 72 of second castellation member 62 are aligned with the gaps 68 of the first castellation member 60 such that the second castellation member 62 slides inside the first castellation member 60 and the engine brake capsule 36 collapses. In the locked, brake active position (FIG. 6), plunger assembly 80 rotates the second castellation member 62 relative to the first castellation member 60 so the fingers 70 align with the first stepped surface 74 such that the second castellation member 62 is locked with the first castellation member 60 and engine braking is activated.

Figure 7:
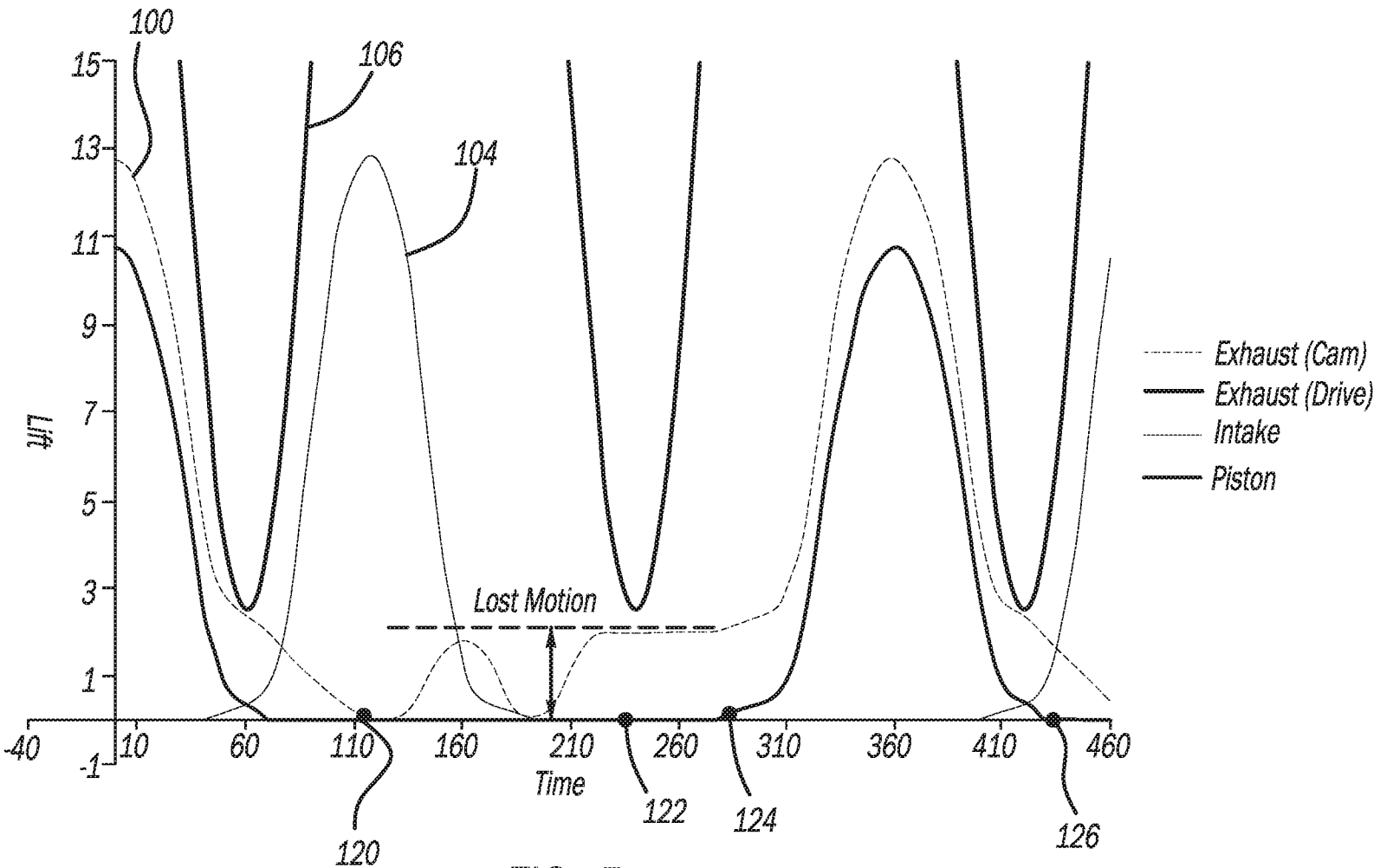
FIG. 7 is a plot illustrating an example valve lift of the valve assembly shown in FIG. 1 operating in a drive mode, according to the present disclosure.
Figure 8:
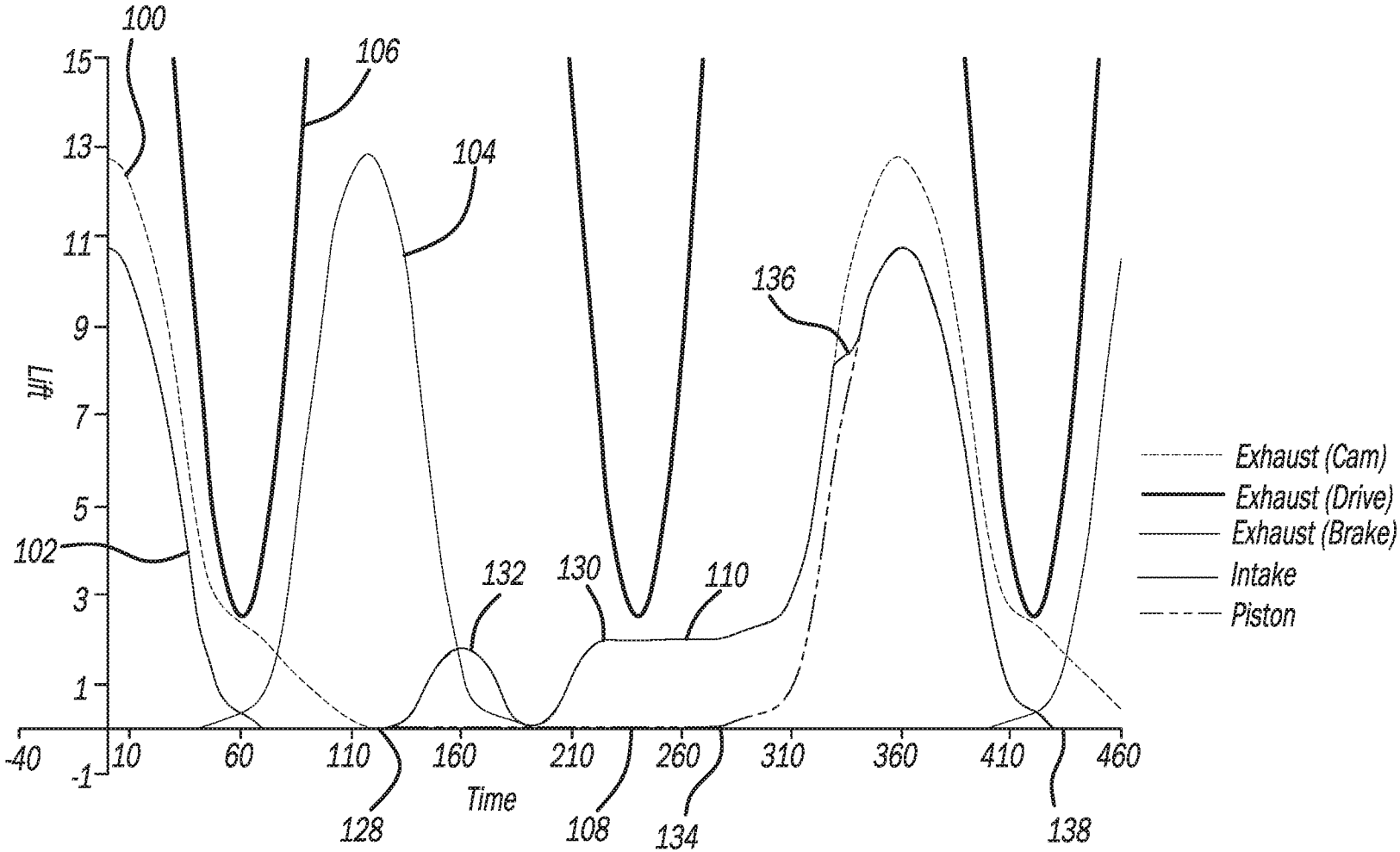
FIG. 8 is a plot illustrating an example valve lift of the valve assembly shown in FIG. 1 operating in a brake mode, according to the present disclosure.
Figure 9:
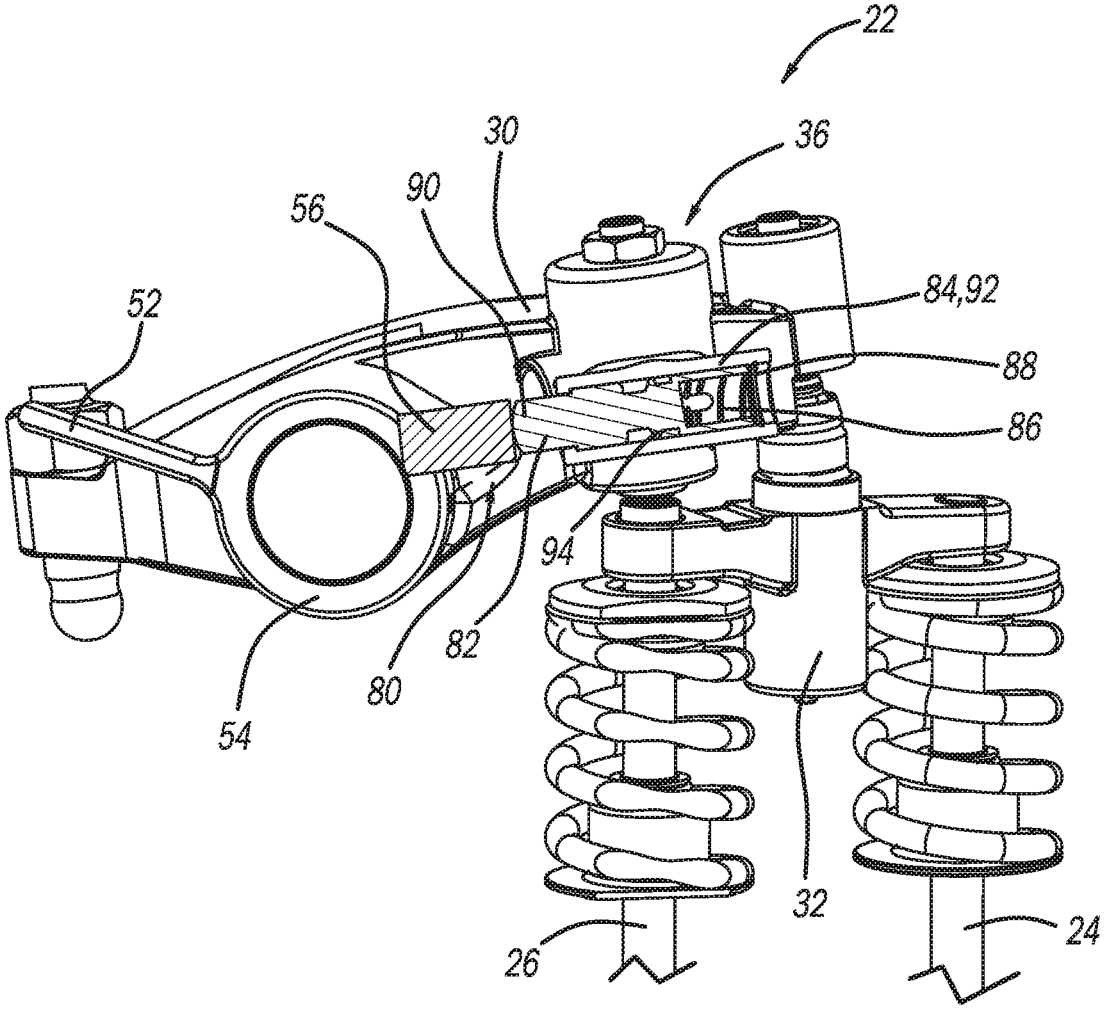
FIG. 9 illustrates the exhaust rocker arm of FIG. 2 in drive mode and on the base circle with the actuator arm in an off position and the castellation unlocked.
Figure 10:
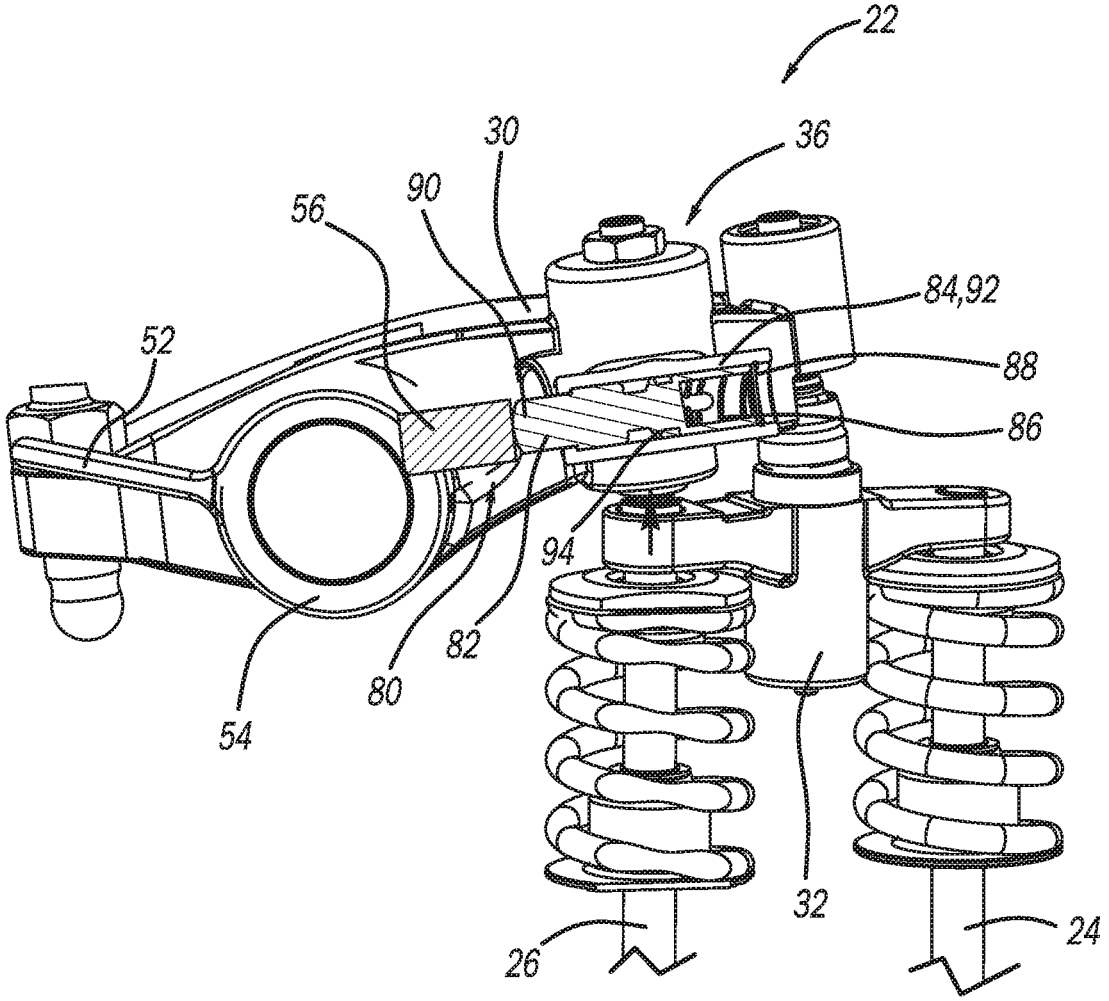
FIG. 10 illustrates the rocker arm in drive mode and during lost motion with the castellation collapsing.
Figure 11:
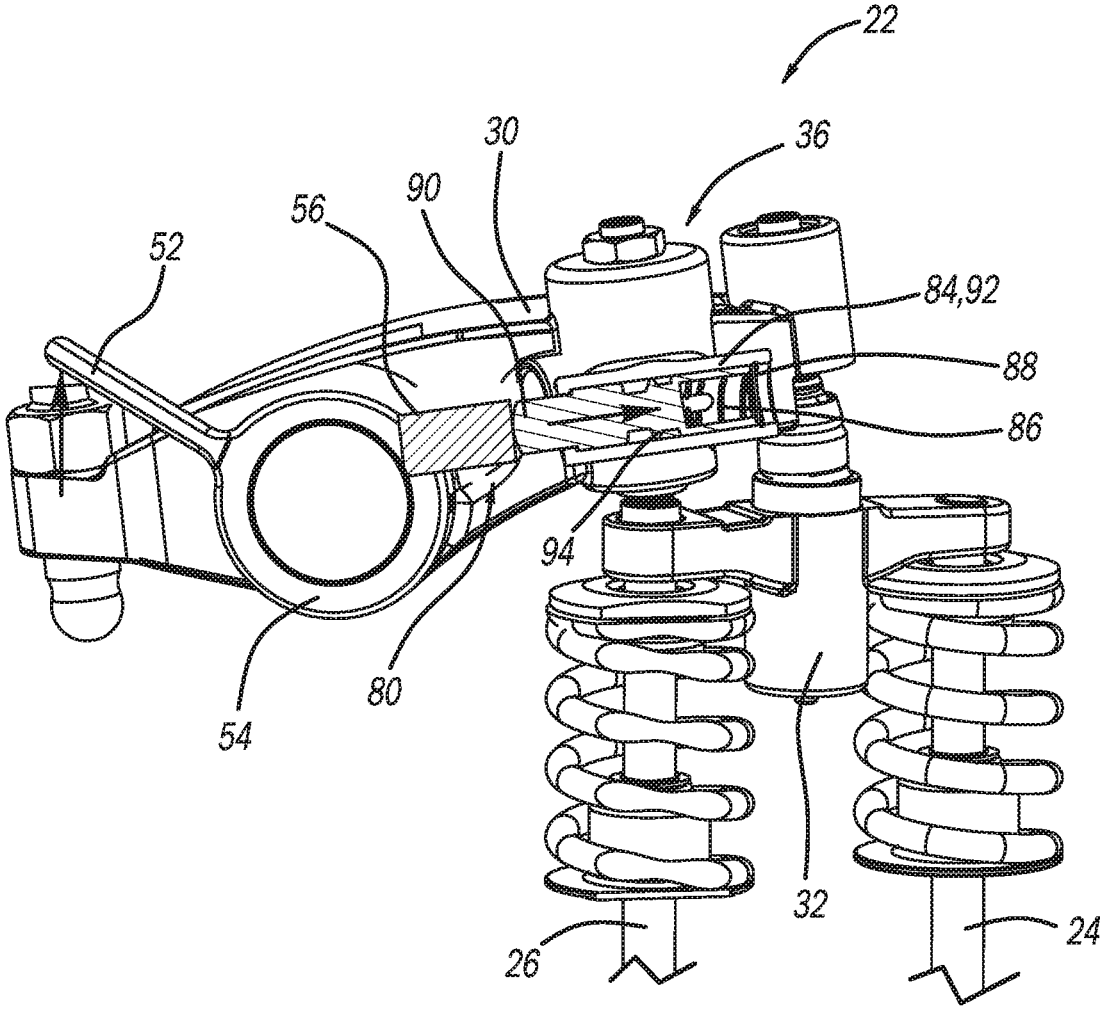
FIG. 11 illustrates the exhaust rocker arm of FIG. 2 in brake mode and on the base circle with the plunger sliding and the castellation locking.

With reference to FIGS. 7 and 8, an example method of operating the valve train assembly 10 is described in more detail. FIG. 7 illustrates the valve train assembly 10 operated in normal drive mode by a controller 98 (FIG. 1). Exhaust cam lift, which is configured to engage and cause rotation of exhaust rocker arm 30, is shown by line 100, lift of the exhaust valves 24, 26 is shown by line 102, intake valve lift is shown by line 104, and piston motion is shown by line 106. FIG. 8 illustrates operation in the brake mode where lift of exhaust valve 24 is shown by line 108, and lift of exhaust valve 26 is shown by line 110. As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

In the drive mode (FIG. 7), at point 120, controller 98 operates actuator 46 to rotate shaft 50 such that actuating arms 48 do not rotate intermediate arm 54 to actuate plunger assembly 80. As such, plunger 82 is biased by biasing mechanism 86 into the default position, which corresponds to the brake inactive position of brake capsule 36 (shown in FIG. 5). Thus, when motion of the exhaust cam (line 100) causes rotation of the exhaust rocker arm 30 at point 122, the brake capsule 36 collapses and does not transfer motion to the exhaust valve 26. Moreover, at the same time, motion of the rocker arm spigot assembly 34 is absorbed by lost motion spring assembly 38 such that motion is not transferred to the valve bridge 32 or exhaust valves 24, 26.

At point 124, the exhaust cam rotates exhaust rocker arm 30 even farther to where lost motion spring assembly 38 no longer absorbs the rocker arm motion, thereby causing downward movement of valve bridge 32 and opening of exhaust valves 24, 26 during the standard time (exhaust stroke) while the brake capsule 36 is fully collapsed. At point 126, exhaust valves 24, 26 close at the standard time (end of exhaust stroke) and brake capsule 36 begins to re-extend as the exhaust cam returns to base circle.

In brake mode (FIG. 8), at point 128, controller 98 operates actuator 46 to rotate shaft 50 such that actuating arms 48 engage and rotate intermediate arm 54. This causes pin 56 to engage plunger 82 and translate it within bore 88. Because plunger annular flange 94 is disposed within slot 78 of the second castellation member 62, translation of the plunger 82 within bore 88 causes subsequent rotational movement of the second castellation member 62 relative to the first castellation member 60, thereby transitioning brake capsule 36 from the unlocked, brake inactive position to the locked, brake active position shown in FIG. 6.

Accordingly, when motion of the exhaust cam (line 100) causes rotation of the exhaust rocker arm 30 at point 130, the locked brake capsule 36 transfers motion to the exhaust valve 26, as shown by line 110. At the same time, motion of the rocker arm spigot assembly 34 is absorbed by lost motion spring assembly 38 such that motion is not transferred to the valve bridge 32 or exhaust valve 24, as shown by line 108. The locked brake capsule 36 also provides brake lift for exhaust valve 26 at point 132 (line 110) while exhaust valve 24 remains closed (line 108). At point 134, exhaust valve 24 opens normally for the exhaust stroke.

Point 136 represents a reset point where the exhaust rocker arm 30 is rotated such that intermediate arm pin 56 falls out of contact with plunger 82, thereby allowing plunger assembly 80 to reset and transition brake capsule 36 back to the unlocked, collapsible mode (FIG. 5). At point 138, exhaust valves 24, 26 close at the standard time (end of exhaust stroke) and brake capsule 36 begins to re-extend as the exhaust cam returns to base circle.

Figure 12:
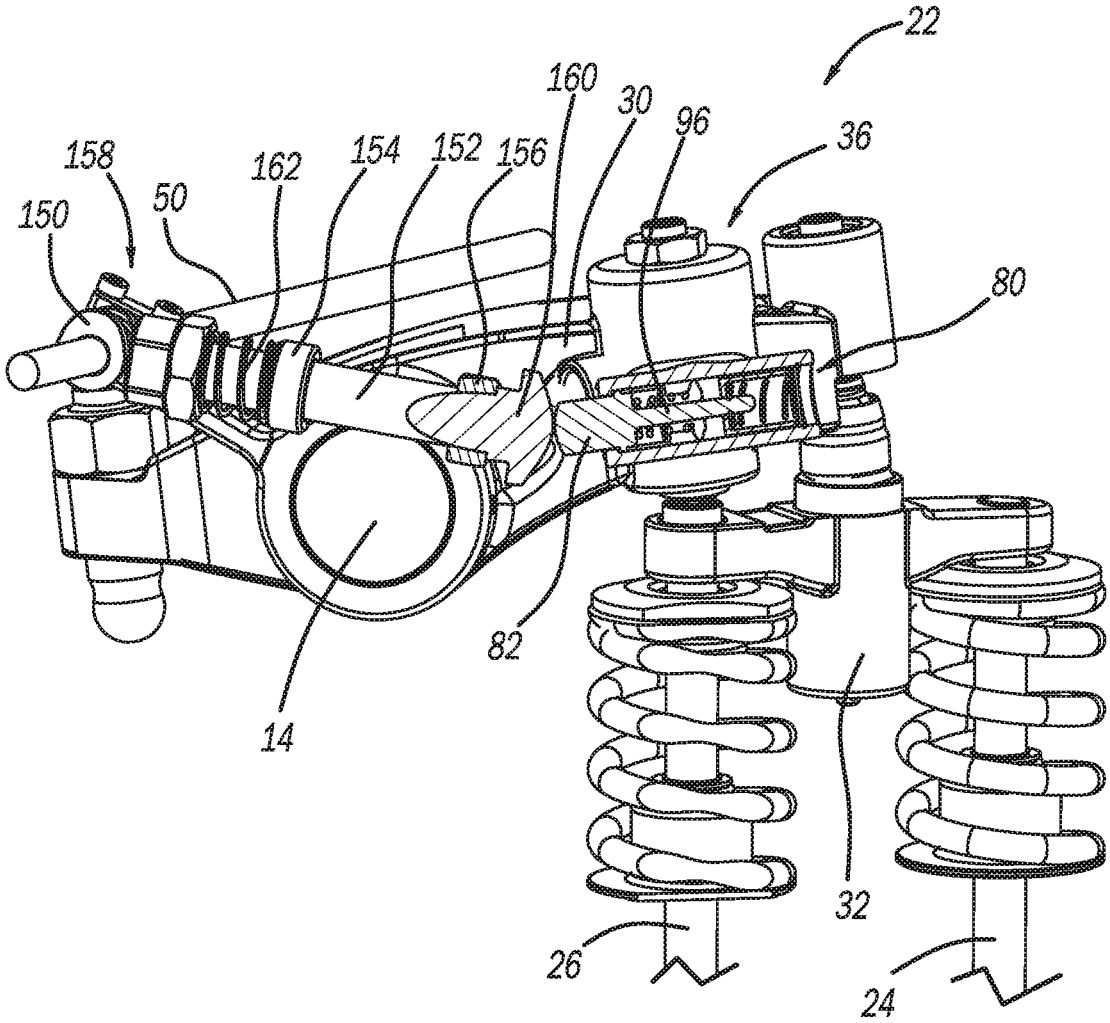
FIG. 12 is a top perspective view of a partial valve train assembly incorporating another rocker arm assembly having a lost motion spring for main lift and a rotating stepped brake capsule with castellation mechanism for engine braking, and an example actuation mechanism for actuating the stepped brake capsule, constructed in accordance to another example of the present disclosure.

FIG. 12 illustrates an alternative arrangement of partial valve train assembly 10 where the plunger assembly 80 is selectively actuated by a cam lobe 150 rotated by the cam shaft 50 and actuator 46 (not shown in FIG. 12). In the example embodiment, an intermediate actuation rod 152 is slidably supported by rings 154, 156 coupled to the exhaust rocker arm 30. The actuation rod 152 includes a first end 158 and an opposite second end 160. The first end 158 is configured to be selectively engaged by cam lobe 150, and second end 160 is configured to selectively engage the first end 90 of plunger 82. A biasing mechanism 162 (e.g., a spring) is disposed between the actuation rod first end 158 and support ring 154 and is configured to bias first end 158 into contact with cam lobe 150.

In one example operation, actuator 46 selectively rotates cam shaft 50 causing cam lobe 150 to rotate into contact with actuation rod first end 158, thereby causing rod second end 160 to move into contact with plunger 82 and effecting movement of brake capsule 36 to the active brake mode, as described herein. Alternatively, brake capsule 36 can be arranged such that the actuation transitions the brake capsule 36 from the active brake mode to the inactive brake mode. Additionally, the plunger 82 can have compliance added thereto with the second biasing mechanism 96 to enable the plunger 82 to collapse until the capsulation is free to move.

Figure 13:
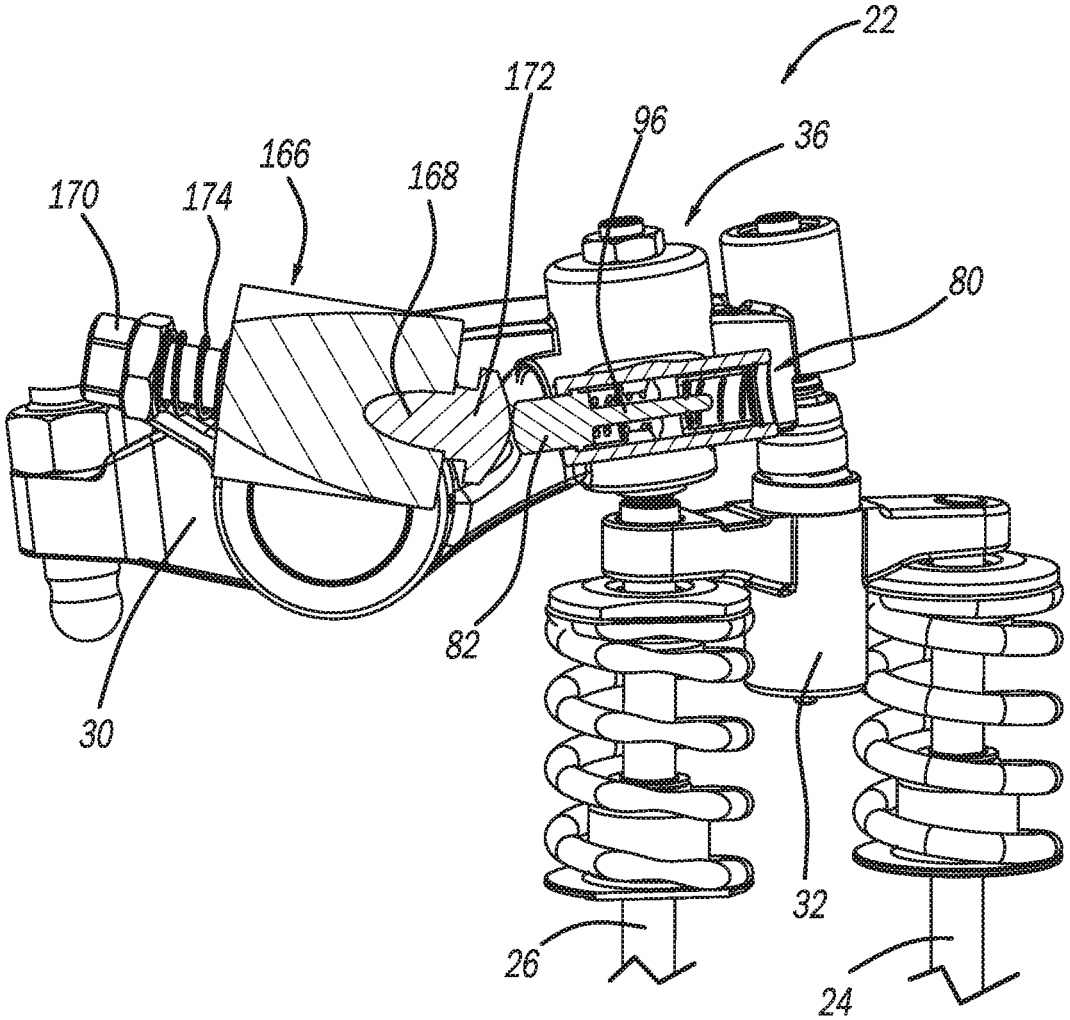
FIG. 13 is a partial cut-away view of the exhaust rocker arm shown in FIG. 12 and having another example actuation mechanism according to the present disclosure.

FIG. 13 illustrates another alternative arrangement of partial valve train assembly 10 where the plunger assembly 80 is selectively actuated by a solenoid. In the example embodiment, exhaust rocker arm 30 includes a solenoid 164 generally having an actuator 166 configured to directly move an intermediate actuation rod 168. As illustrated, actuation rod 168 includes a first end 170 and an opposite second end 172, which is configured to selectively engage the first end 90 of plunger 82. A biasing mechanism 174 (e.g., a spring) is disposed between the actuation rod first end 170 and actuator 166 and is configured to bias second end 172 out of contact with plunger 82 (or at least into a contacted position where actuation rod 168 transfers little or no motion to plunger 82).

In one example operation, actuator 166 is selectively actuated to translate intermediate actuation rod 168 into translating contact with plunger 82, thereby effecting movement of brake capsule 36 to the active brake mode, as described herein. Alternatively, brake capsule 36 can be arranged such that the actuation transitions the brake capsule 36 from the active brake mode to the inactive brake mode.

Figure 14:
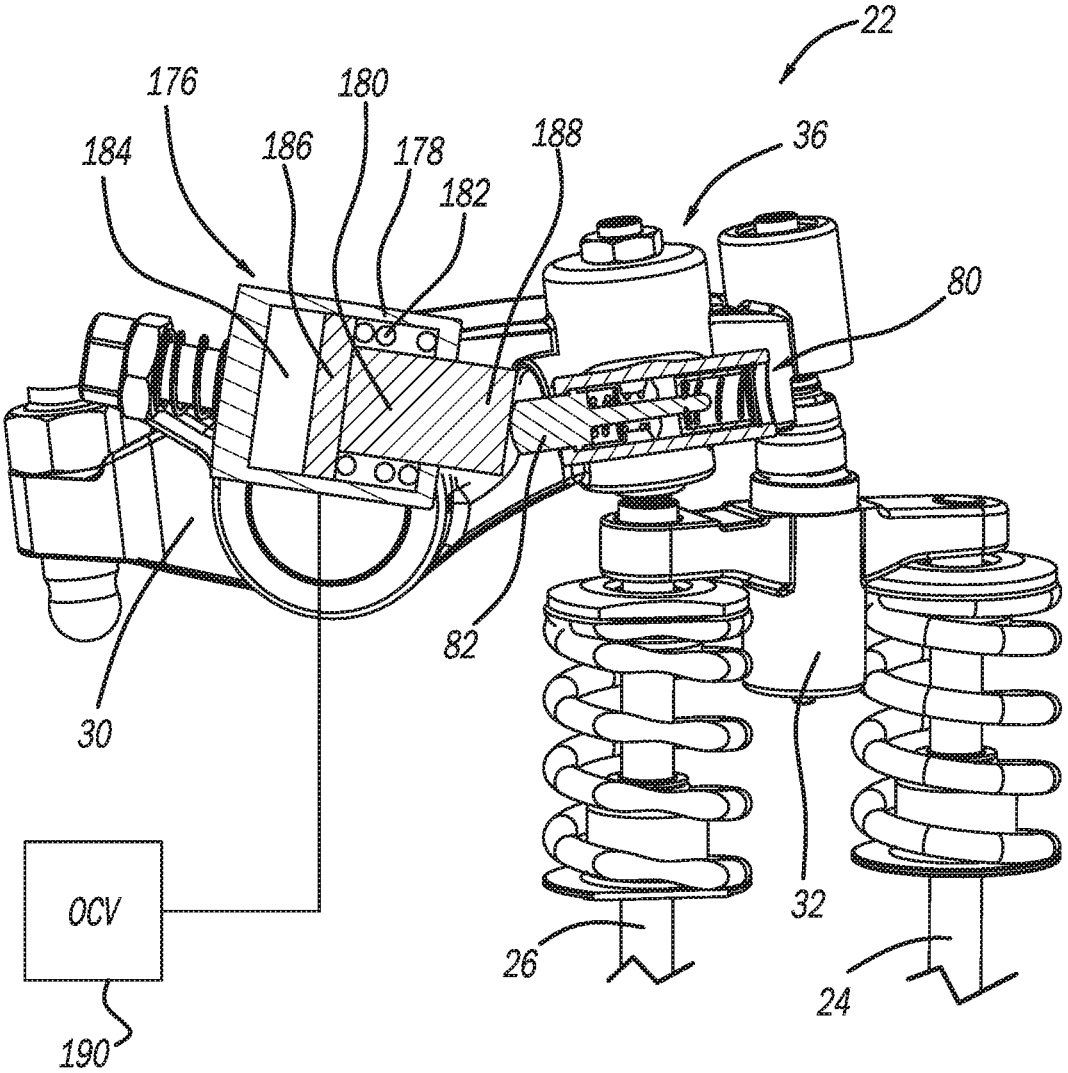
FIG. 14 is a partial cut-away view of the exhaust rocker arm shown in FIG. 12 and having yet another example actuation mechanism according to the present disclosure.

FIG. 14 illustrates another alternative arrangement of partial valve train assembly 10 where the plunger 82 is selectively actuated by a hydraulic actuator. In the example embodiment, exhaust rocker arm 30 includes a hydraulic actuator 176 generally having a body 178, a hydraulically actuated pin 180, and a biasing mechanism 182 (e.g., a spring). The body 178 defines a cavity or chamber 184 configured to slidingly receive the pin 180 and the biasing mechanism 182. The pin 180 is configured to directly translate plunger 82 and includes a first end 186 and an opposite second end 188, which is configured to selectively engage the first end 90 of plunger 82. The biasing mechanism 182 is disposed within the body 178 and is configured to bias the pin second end 188 out of contact with plunger 82 (or at least into a contacted position where pin 180 transfers little or no motion to plunger 82). The hydraulic actuator 176 is fluidly coupled to a pressurized fluid source such as an oil control valve 190.

In one example operation, hydraulic actuator 176 is selectively actuated by supplying fluid to chamber 184, which causes pin 180 to overcome the bias of biasing mechanism 182 and translate into contact with the plunger 82, thereby effecting movement of brake capsule 36 from the inactive brake mode to the active brake mode (or vice versa in alternative arrangements).

Figure 15:
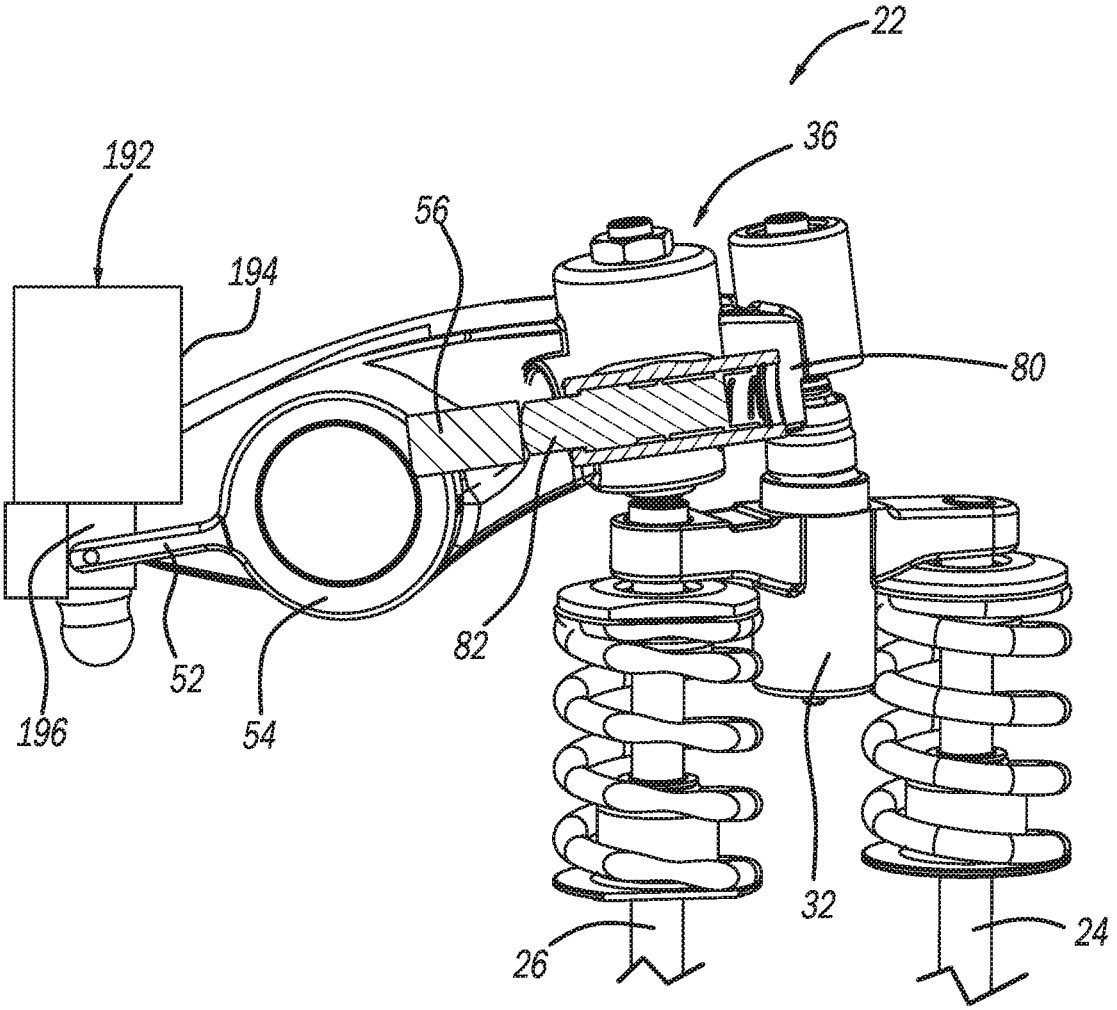
FIG. 15 is a partial cut-away view of the exhaust rocker arm shown in FIG. 2 and having another example actuation mechanism according to the present disclosure.

FIG. 15 illustrates another alternative embodiment of partial valve train assembly 10 where the plunger assembly 80 is selectively actuated by a solenoid 192 that directly contacts or is coupled to rotating intermediate arm 54. In the example embodiment, solenoid 192 generally includes a solenoid body 194 and an actuation pin 196. In one example operation, solenoid 192 is selectively actuated to move actuation pin 196 and rotate intermediate arm 54, for example by moving projection 52. This causes pin 56 to engage and translate plunger 82, thereby effecting movement of brake capsule 36 to the active brake mode, as described herein. Alternatively, brake capsule 36 can be arranged such that the actuation transitions the brake capsule 36 from the active brake mode to the inactive brake mode.

Figure 16:
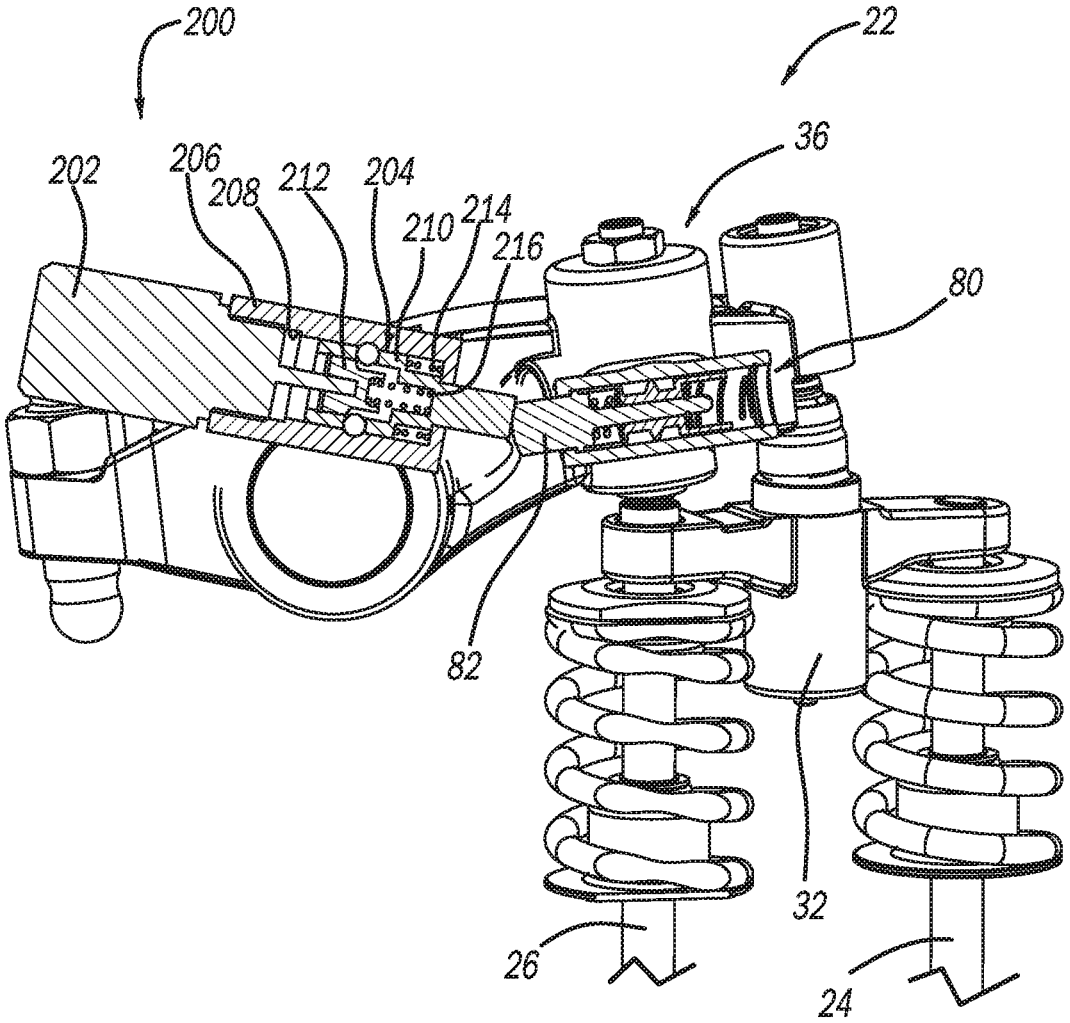
FIG. 16 is a partial cut-away view of the exhaust rocker arm shown in FIG. 12 and having yet another example actuation mechanism according to the present disclosure.

FIG. 16 illustrates another alternative arrangement of partial valve train assembly 10 where the plunger assembly 80 is selectively actuated by a solenoid assembly. In the example embodiment, exhaust rocker arm 30 includes a solenoid assembly 200 generally having a solenoid 202 acting directly on a plunger with detent 204. The plunger with detent 204 generally includes a body 206 defining a cavity 208 configured to slidingly receive a first plunger 210. A second plunger 212 is slidingly disposed within the first plunger 210. A first biasing mechanism 214 is configured to bias the first plunger 210 toward solenoid 202, and a second biasing mechanism 216 is similarly configured to bias the second plunger 212 toward solenoid 202.

During actuation of solenoid 202, second plunger 212 is translated toward and into contact with plunger 82 to effect operation of the brake mode (e.g., brake activated). Accordingly, the detent plunger 204 decreases required force from solenoid 202 and reduces holding force. Alternatively, brake capsule 36 can be arranged such that the actuation transitions the brake capsule 36 from the active brake mode to the inactive brake mode.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A rocker arm assembly operable in a combustion engine drive mode and an engine braking mode, and configured to selectively open first and second exhaust valves, the assembly comprising:

a rocker shaft;

an exhaust valve rocker arm configured to receive and rotate about the rocker shaft; and a rotating stepped engine brake capsule coupled to the exhaust valve rocker arm and having a castellation mechanism, the rotating stepped engine brake capsule actuated by an intermediate rod, wherein the intermediate rod is actuated by a cam lobe disposed on a cam shaft, wherein the rotating stepped engine brake capsule is movable between a locked, engine brake active position and an unlocked, engine brake inactive position.

2. A rocker arm assembly operable in a combustion engine drive mode and an engine braking mode, and configured to selectively open first and second exhaust valves, the assembly comprising:

a rocker shaft;

an exhaust valve rocker arm configured to receive and rotate about the rocker shaft;

a rotating stepped engine brake capsule coupled to the exhaust valve rocker arm and having a castellation mechanism, wherein the rotating stepped engine brake capsule is movable between a locked, engine brake active position and an unlocked, engine brake inactive position; and a plunger assembly integrated into the exhaust valve rocker arm and operatively associated with the rotating stepped engine brake capsule to move the rotating stepped engine brake capsule between the locked and unlocked positions, wherein the plunger assembly is actuated by an intermediate rod, and the intermediate rod is actuated by a solenoid.

3. A rocker arm assembly operable in a combustion engine drive mode and an engine braking mode, and configured to selectively open first and second exhaust valves, the assembly comprising:

a rocker shaft;

an exhaust valve rocker arm configured to receive and rotate about the rocker shaft; and a rotating stepped engine brake capsule coupled to the exhaust valve rocker arm and having a castellation mechanism, the rotating stepped engine brake capsule actuated by a rotating intermediate arm, the intermediate arm actuated by a camshaft, wherein the rotating stepped engine brake capsule is movable between a locked, engine brake active position and an unlocked, engine brake inactive position.

4. A rocker arm assembly operable in a combustion engine drive mode and an engine braking mode, and configured to selectively open first and second exhaust valves, the assembly comprising:

a rocker shaft;

an exhaust valve rocker arm configured to receive and rotate about the rocker shaft; and a rotating stepped engine brake capsule coupled to the exhaust valve rocker arm and having a castellation mechanism, the rotating stepped engine brake capsule actuated by a rotating intermediate arm configured to receive the rocker shaft, the intermediate arm actuated to rotate about the rocker shaft by a solenoid, wherein the rotating stepped engine brake capsule is movable between a locked, engine brake active position and an unlocked, engine brake inactive position.

5. A rocker arm assembly operable in a combustion engine drive mode and an engine braking mode, and configured to selectively open first and second exhaust valves, the assembly comprising:

a rocker shaft;

an exhaust valve rocker arm configured to receive and rotate about the rocker shaft; and a rotating stepped engine brake capsule coupled to the exhaust valve rocker arm and having a castellation mechanism, wherein the rotating stepped engine brake capsule is movable between a locked, engine brake active position and an unlocked, engine brake inactive position; and a plunger assembly integrated into the exhaust valve rocker arm and operatively associated with the rotating stepped engine brake capsule to move the rotating stepped engine brake capsule between the locked and unlocked positions, wherein the plunger assembly is actuated by a solenoid assembly having a solenoid acting on a plunger with detent.

6. The rocker arm assembly of claim 2, wherein the plunger assembly is disposed within a bore formed in a body of the exhaust valve rocker arm.

7. The rocker arm assembly of claim 6, wherein the plunger assembly comprises a plunger defining a seat to at least partially receive a biasing mechanism.

8. The rocker arm assembly of claim 7, wherein the plunger includes an annular flange configured to be received within the rotating stepped engine brake capsule, wherein translating movement of the plunger is configured to move the rotating stepped engine brake capsule between the locked and unlocked positions.

9. The rocker arm assembly of claim 5, wherein the plunger with detent includes a body defining a cavity configured to slidingly receive a first plunger.

10. The rocker arm assembly of claim 9, wherein a second plunger is slidingly disposed within the first plunger.

11. The rocker arm assembly of claim 10, wherein a first biasing mechanism is configured to bias the first plunger toward the solenoid, and a second biasing mechanism is configured to bias the second plunger toward the solenoid.

* * * * *